US005339990A

United States Patent [19]

Wilder

[11] Patent Number: 5,339,990

[45] Date of Patent: Aug. 23, 1994

[54] ADJUSTABLE PUMP DISPENSER

[76] Inventor: Robert E. Wilder, 605 N. Tazewell St., Arlington, Va. 22203

[21] Appl. No.: 974,299

[22] Filed: Nov. 10, 1992

[51] Int. Cl.[5] ..... B65D 88/54; B67D 5/52

[52] U.S. Cl. ..... 222/135; 222/145; 222/282; 222/287; 222/318; 222/321

[58] Field of Search ..... 222/108–110, 222/129, 134, 135, 137, 145, 144.5, 255, 266, 267, 269, 270, 276, 282, 287, 288, 309, 321, 385; 239/304, 333, 331, 329

[56] References Cited

U.S. PATENT DOCUMENTS

| | | | |
|---|---|---|---|
| 1,071,432 | 8/1913 | Kelley . | |
| 2,413,136 | 12/1946 | Burger | 222/282 |
| 3,456,846 | 7/1969 | Gross . | |
| 3,474,938 | 10/1969 | Clevenger | 222/318 |
| 3,543,965 | 12/1970 | Lehmann . | |
| 3,722,750 | 3/1973 | Fox, Jr. . | |
| 3,760,986 | 9/1973 | Castner et al. . | |
| 3,786,963 | 1/1974 | Metzler, III . | |
| 3,814,287 | 6/1974 | Darbon et al. . | |
| 3,850,346 | 11/1974 | Richardson et al. . | |
| 3,917,172 | 11/1975 | O'Hare . | |
| 3,918,612 | 11/1975 | Voulgaris . | |
| 4,006,841 | 2/1977 | Alticosalian . | |
| 4,014,463 | 3/1977 | Hermann . | |
| 4,081,111 | 3/1978 | Sandow | 222/309 |
| 4,121,736 | 8/1978 | McGaw, Jr. . | |
| 4,271,984 | 6/1981 | Ducros et al. . | |
| 4,335,837 | 6/1982 | Bono | 222/276 X |
| 4,355,739 | 10/1982 | Vierkotter . | |
| 4,460,109 | 7/1984 | Ducros et al. . | |
| 4,549,674 | 10/1985 | Alticosalian . | |
| 4,585,149 | 4/1986 | Zulauf . | |
| 4,595,127 | 6/1986 | Stoody . | |
| 4,767,059 | 8/1988 | Crapser et al. . | |
| 4,826,048 | 5/1989 | Skorka et al. . | |
| 4,838,457 | 6/1989 | Swahl et al. . | |
| 4,871,092 | 10/1989 | Maerte . | |
| 4,893,729 | 6/1990 | Iggulden et al. . | |
| 4,902,281 | 2/1990 | Avoy | 222/137 X |
| 4,913,319 | 4/1990 | Root | 222/255 X |
| 4,949,874 | 8/1990 | Fiedler et al. | 222/135 |
| 4,993,594 | 2/1991 | Becker et al. . | |
| 5,009,342 | 4/1991 | Lawrence et al. . | |
| 5,152,431 | 10/1992 | Gardner | 222/144.5 X |
| 5,224,627 | 7/1993 | Weag | 222/135 |

FOREIGN PATENT DOCUMENTS

| | | | |
|---|---|---|---|
| 2641337 | 7/1990 | France | 222/321 |
| 582459 | 10/1977 | Japan | 222/321 |

*Primary Examiner*—Kevin P. Shaver

*Attorney, Agent, or Firm*—Jacobson, Price, Holman & Stern

[57] ABSTRACT

Liquids are segregated into separate chambers within a common container. The chambers are formed by fabricating the container in an hourglass design thus dividing it into upper and lower segments. The chambers are serviced by separate pumps which draw the constituent liquids independently and deliver them through a common outlet. The chambers are isolated from one another by inserting the pump servicing the lower chamber through the upper chamber and fitting it snugly into the waist of the hourglass. The pumps servicing the upper and lower chambers move in tandem and are fixed together by a common pump head. The pump head also serves as the outlet through which the constituent liquids are delivered. Liquid is delivered in fixed quantities from the lower chamber via an elongated pump mechanism. Liquid is delivered in adjustable quantities from the upper chamber via a modified pump design. This modified design permits the normal delivery of the constituent liquid, the recirculation of liquid back into the upper chamber, or both.

19 Claims, 7 Drawing Sheets

ADJUSTABLE PUMP DISPENSER

FIELD OF THE INVENTION

A pump dispenser for the storage of two constituent compounds and their delivery in user adjustable ratios. It is intended for use with liquid cleaners, cosmetic products, medications, and other non-viscous or semi-viscous compounds where it is desirable to permit the user to adjust the relative concentration of the product dispensed. It is also intended for use with reactive compounds where it is desirable to keep the compounds segregated until they are dispensed and where it is desirable to permit the user to adjust the relative concentration of the product dispensed.

BACKGROUND OF THE INVENTION

Several differing mechanisms exist which claim to permit the storage of two or more constituent compounds and adjustment of the relative concentration of the product dispensed. Each of these mechanisms, however, possess one or more design flaws which may impede the product's functionality. These flaws tend to fall into four categories: energy transmission, time to outlet, relative viscosities, and excessive reservoir-/inadequate mixing.

Energy Transmission: All multi-chamber "squeeze type" bottles suffer, to one degree or another, from problems involving energy transmission. In the squeeze type bottle, it is necessary for the user to apply pressure to each compartment in order to displace that compartment's contents. To ensure consistency of the amalgamated product, the relative pressure that the user applies to each of the compartments must remain constant throughout compression and from use to use. If, for example, the user changes his grip or the contents of one compartment have been depleted, then the relative pressure applied and, accordingly, the relative quantity of each liquid delivered will vary. This problem is clearly evident in the mechanisms described in the Iggulden et al, Swahl et al, and Voulgaris patents (U.S. Pat. Nos. 4,893,729; 4,838,457; and 3,918,612, respectively). It is, however, minimized in the mechanisms described in the Becker et al, Richardson et al, Darbon et al, and Zulauf patents (U.S. Pat. Nos. 4,993,594; 3,850,346; 3,814,287; and 4,585,149, respectively).

Time to Outlet: In all multi-liquid containers, it is essential that each of the constituent liquids reach the container outlet simultaneously. If one constituent liquid reaches the outlet prior to the other constituent liquid(s), the initial output will consist of the "fast moving" constituent liquid only. The greater the viscosity of the liquids or the greater the difference between the viscosity of the liquids, the greater the problem. This problem is especially evident in "pour type" squeeze bottles such as those described in the Iggulden et al, Swahl et al, and Voulgaris patents (U.S. Pat. Nos. 4,893,729; 4,838,457; and 3,918,612, respectively). The problem, however, can be minimized in those squeeze bottles which draw liquid from the bottom of the container such as the mechanism embodied in the Becker et al patent (U.S. Pat. No. 4,993,594).

Relative Viscosities: As discussed previously, squeeze bottles suffer from a variety of problems including energy transmission and "time to outlet". These problems may be exacerbated if the viscosities of the constituent liquids differ markedly. The relative viscosities of the constituent liquids, however, have an even more profound impact on the functionality of "pump type" bottles. If the pump type bottle utilizes a single pump to draw more than one constituent liquid, it will preferentially draw the liquid with the lower viscosity (i.e., take the course of least resistance). Thus, for example, if one chamber contains ketchup and the other contains water, the pump will tend to draw water only. Further, once any constituent liquid has been depleted completely, the pump will draw only air (the least viscous compound) and cease to work. This problem exists, for example, in the mechanisms described in the Vierkotter patent (U.S. Pat. No. 4,355,739) and in the Metzler patent (U.S. Pat. No. 3,786,963). The problem does not exist with multiple pump designs such as those described in the Skorka et al and Castner et al patents (U.S. Pat. Nos. 4,826,048 and 3,760,986, respectively).

Excessive Reservoir/Inadequate Mixing: Delivery of the constituent liquids in blended form creates a dilemma. On the one hand, it is desirable to mix the constituent liquids thoroughly prior to delivery. On the other hand, it is advantageous for the user to receive the desired concentration immediately rather than first having to clear the remnants of the previous mix. In order to mix the constituent liquids thoroughly, they must be combined and mixed within the dispenser. This, however, involves the creation of a reservoir containing the constituent liquids at a specific ratio. Thus, upon each use, the user will initially receive a mix of the constituent liquids at the concentration of the previous use. Only after the contents of the reservoir have been replaced completely will the user receive the desired mix. Several patents reveal dispensers with excessively large reservoirs. Further, in most of these mechanisms, no mechanical means is utilized to mix the constituent liquids (other than uniting them in a con, non chamber). Richardson et al (U.S. Pat. No. 3,850,346) discloses use of a sequential baffling system to provide thorough mixing; Skorka et al (U.S. Pat. No. 4,826,048) discloses use of helical or spiral groove-like swirl channels to intensely mix components; Darbon et al (U.S. Pat. No. 3,814,287) discloses an acknowledgment of a need for a device to facilitate uniform blending. Therefore, not only is there often a large reservoir, but such reservoir generally adds little to the functionality of the product as in Iggulden et al (U.S. Pat. No. 4,893,729), Vierkotter (U.S. Pat. No. 4,355,739), Zulauf (U.S. Pat. No. 4,585,149), and Ducros et al (U.S. Pat. No. 4,460,109).

SUMMARY OF THE INVENTION

By the present invention, liquids are segregated into separate chambers within a common container. The chambers are formed by fabricating the container in an hourglass design thus dividing it into upper and lower segments- The chambers are serviced by separate pumps which draw the constituent liquids independently and deliver them through a common outlet. The chambers are isolated from one another by inserting the pump servicing the lower chamber through the upper chamber and fitting it snugly into the waist of the hourglass. The pumps servicing the upper and lower chambers move in tandem and are fixed together by a common pump head. The pump head also serves as the outlet through which the constituent liquids are delivered.

Liquid is delivered in fixed quantities from the lower chamber via an elongated pump mechanism. Liquid is delivered in adjustable quantities from the upper chamber via a modified pump design. This modified design permits the normal delivery of the constituent liquid, the recirculation of liquid back into the upper chamber, or both. Although the quantity of liquid drawn from the upper chamber is fixed, the proportion of that liquid which is recirculated back into the upper chamber relative to the liquid actually delivered therefrom is adjustable and controlled by a simple valve mechanism. By altering the quantity of liquid delivered from the upper chamber while the quantity of liquid delivered from the lower chamber remains fixed, the user is able to determine the concentration of the combined output.

The present invention resolves most of the design flaws present in other products while maintaining or enhancing the product's economic feasibility- Problems associated with energy transmission and time to outlet have been fully resolved through the use of a pump dispenser. Problems associated with relative viscosities have been fully resolved through a multiple pump design. Problems associated with an excessive reservoir or inadequate mixing, are minimized through the use of a small static mixer.

The principal difference between the present invention and prior mechanisms is the use of an adjustable multiple pump design. Of those prior mechanisms discussed above, only the Vierkotter, Metzler, Castner et al, and Skorka et al patents (U.S. Pat. Nos. 4,355,739; 3,786,963; 3,760,986; and 4,826,048, respectively) utilize pump designs. The pump design eliminates problems associated with energy transmission and time to outlet pervasive in the squeeze designs. Unlike a squeeze bottle, the pump dispenser will always deliver a fixed quantity of liquid with each stroke. Furthermore, since liquid is drawn from the bottom of the pump bottle and maintained in the dip tube via a one way valve, no problems associated with time to outlet exist.

The Vierkotter and Metzler designs utilize a single pump to draw liquid from two separate chambers. As discussed previously, if the chambers contain liquids of unequal viscosities or if one chamber is depleted prior to the other, the product will fail. The present invention resolves these problems through the use of two pumps.

Unlike the Vierkotter and Metzler designs, the Castner et al and Skorka et al designs utilize multiple pumps. However, neither of these two mechanisms is user adjustable. The Skorka et al patent, unlike the Castner et al patent, alludes to user adjustability, but it itself is not user adjustable. The adjustment mechanism described in the Maerte patent (U.S. Pat. No. 4,871,092), the U.S. equivalent of German patent application No. P 32 35 910.7 to which the Skorka et al patent refers, is neither compatible with the Skorka et al design nor similar to the adjustable mechanism described herein.

In the present invention, each chamber is serviced by a separate pump and the constituent liquids are drawn independently. The dispenser is best viewed as two separate containers, each of which functions fully independently of the other. The viscosity or presence of liquid in one chamber has no impact upon the mechanism's ability to consistently deliver liquid from the other chamber.

In order to permit the user to adjust the mix of the constituent liquids, a modified pump design was necessary. This design had to meet two important criteria. First, because the pumps are fixed together and, therefore, work in tandem, the stroke length of the adjustable pump had to be equal to that of the second pump. Second, the adjustable pump had to deliver a consistent output of liquid throughout its stroke. It could not deliver a stream of liquid in the first half of the stroke and nothing in the second half of the stroke. If this were the case, the concentration of the combined liquids delivered would be erratic and resemble a sine or castellated wave.

The design of the present invention meeting the above criteria is a recirculating system which allows one of the constituent liquids to be channeled to the container outlet (where it is mixed with the other constituent liquid), channeled back into the chamber from which it was drawn, or both. Recirculation can be achieved through a simple valve mechanism, several variations of which have also been developed.

It is therefore an object of the present invention to provide different liquids segregated into separate chambers of a common container with separated pumps drawing the liquids for delivery through a common outlet.

It is another object of the present invention to provide different liquids segregated into separate chambers of a common container with separated pumps drawing the liquids for delivery through a common outlet with a common pump head connected to both pumps.

It is another object of the present invention to provide different liquids segregated into separate chambers of a common container with separated pumps drawing the liquids for delivery through a common outlet with a common pump head connected to both pumps and the recirculation of a controlled amount of liquid from one chamber back into said chamber.

It is another object of the present invention to provide different liquids segregated into separate chambers of a common container with separated pumps drawing the liquids for delivery through a common outlet with a common pump head connected to both pumps and the recirculation of a controlled amount of liquid from one chamber back into said chamber and, therefore, controllably increasing or decreasing the quantity of said liquid delivered from said chamber.

It is yet another object of the present invention to provide different liquids segregated into separate chambers of a common container with separated pumps drawing the liquids for delivery through a common outlet with a common pump head connected to both pumps and the recirculation of a controlled amount of liquid from one chamber back into said chamber and, therefore, controllably increasing or decreasing the quantity of said liquid delivered from said chamber relative to the quantity of liquid delivered from the other chamber.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
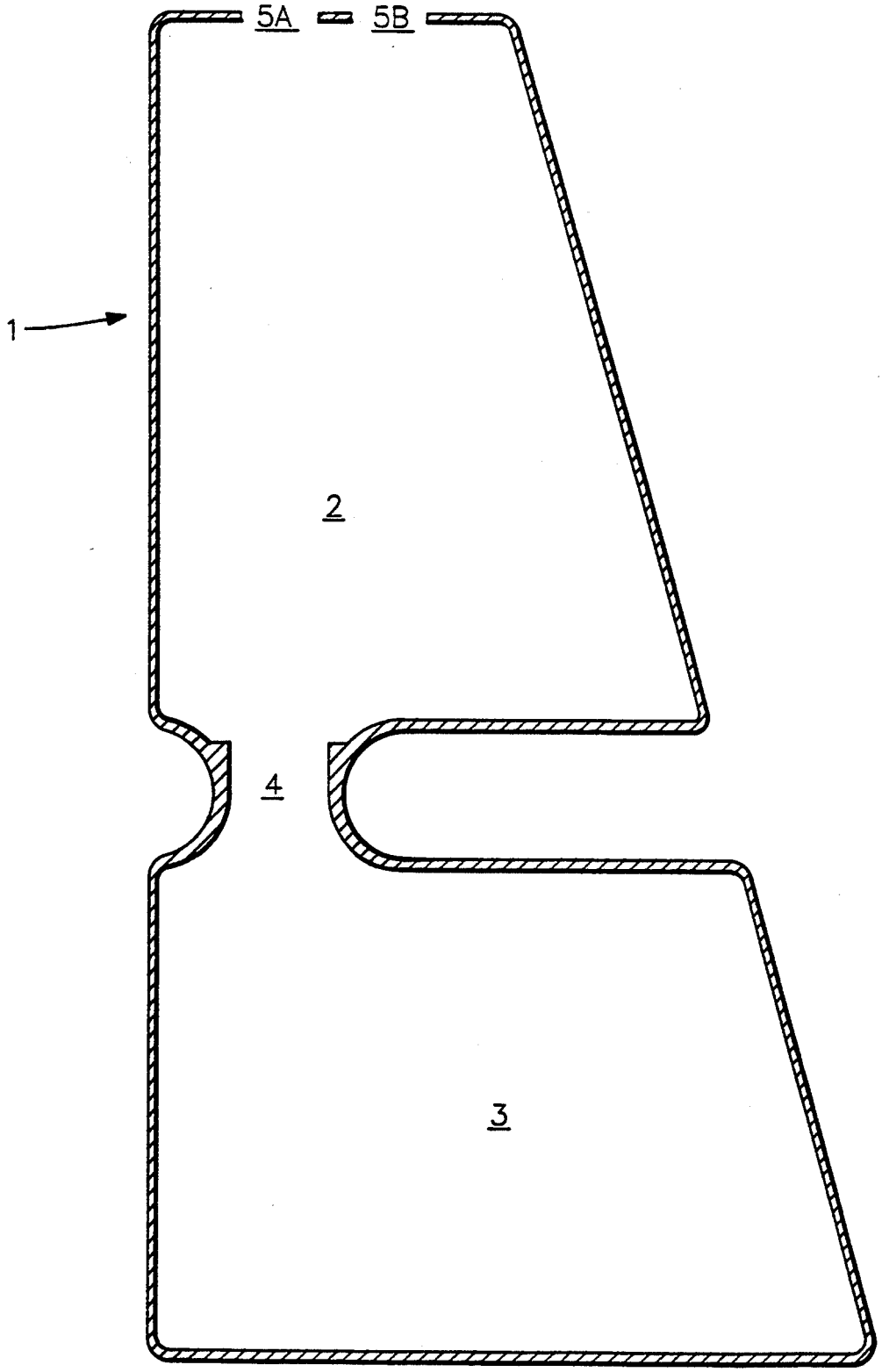
FIG. 1 is a sectional view of a two-chambered container.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1, in particular, a container i is shown which is divided into upper chamber 2 and lower chamber 3 by a narrowed waist 4. The container has two openings 5A and 5B for insertion of pumps into each of chambers 2 and 3. The pumps are depicted in FIG. 2 and FIGS. 4A–4C, respectively.

Figure 2:
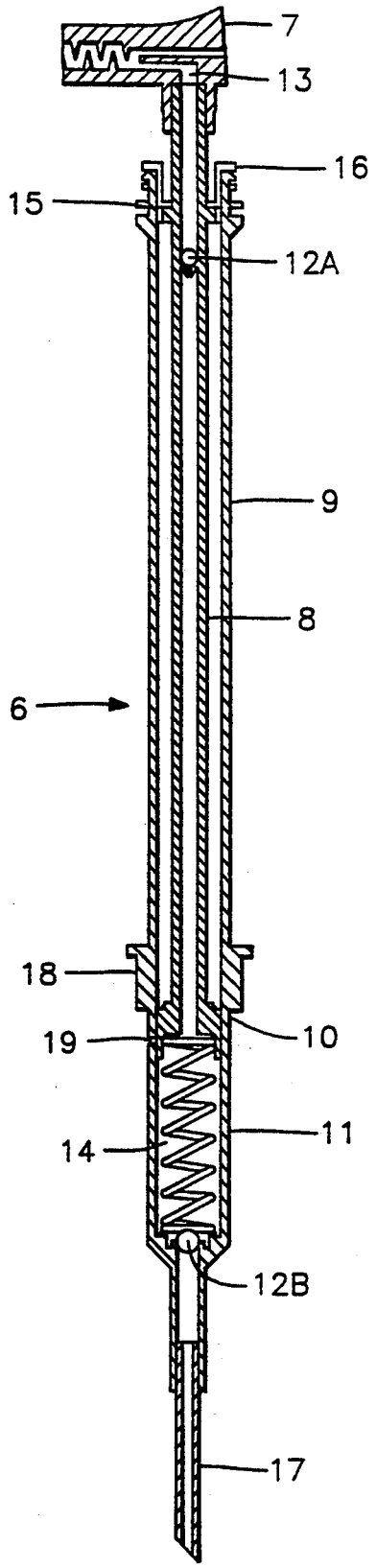
FIG. 2 is a sectional view of a pump for the lower chamber.

FIG. 2 illustrates the pump 6 for serving the lower chamber 3. The pump head 7 is depressed to move the hollow piston rod 8 and its piston 10 downward within casing 9 through lowermost cylindrical portion 11 of the casing 9. This movement causes all liquid in the cylindrical portion 11 to be displaced upward into the hollow piston rod 8. The two one-way valves 12A and 12B permit liquid to flow only in an upward vertical direction. The spring 14 forces the piston 10 back from its depressed position until contact of the stop 15 of the hollow piston rod 8, with the seal plug 16 prevents further movement. The withdrawal of the piston 10 from the cylindrical portion 11 creates a vacuum in the cylindrical portion 11 and liquid is drawn upwardly into the cylindrical portion 11 from the lower chamber 3 through the dip tube 17. Repeated reciprocation of the pump head 7 therefore forces liquid up through the hollow piston rod 8 and out of the container 1 through the channel 13 which is formed in the pump head 7 and is in communication with the hollow piston rod 8.

The stop 15 is integral with the hollow piston rod 8 and is located below the seal plug 16. Seal plug 16 extends from the uppermost edge of casing 9 and depends downwardly therefrom, into the casing 9 and surrounding hollow piston rod 8.

Figure 3:
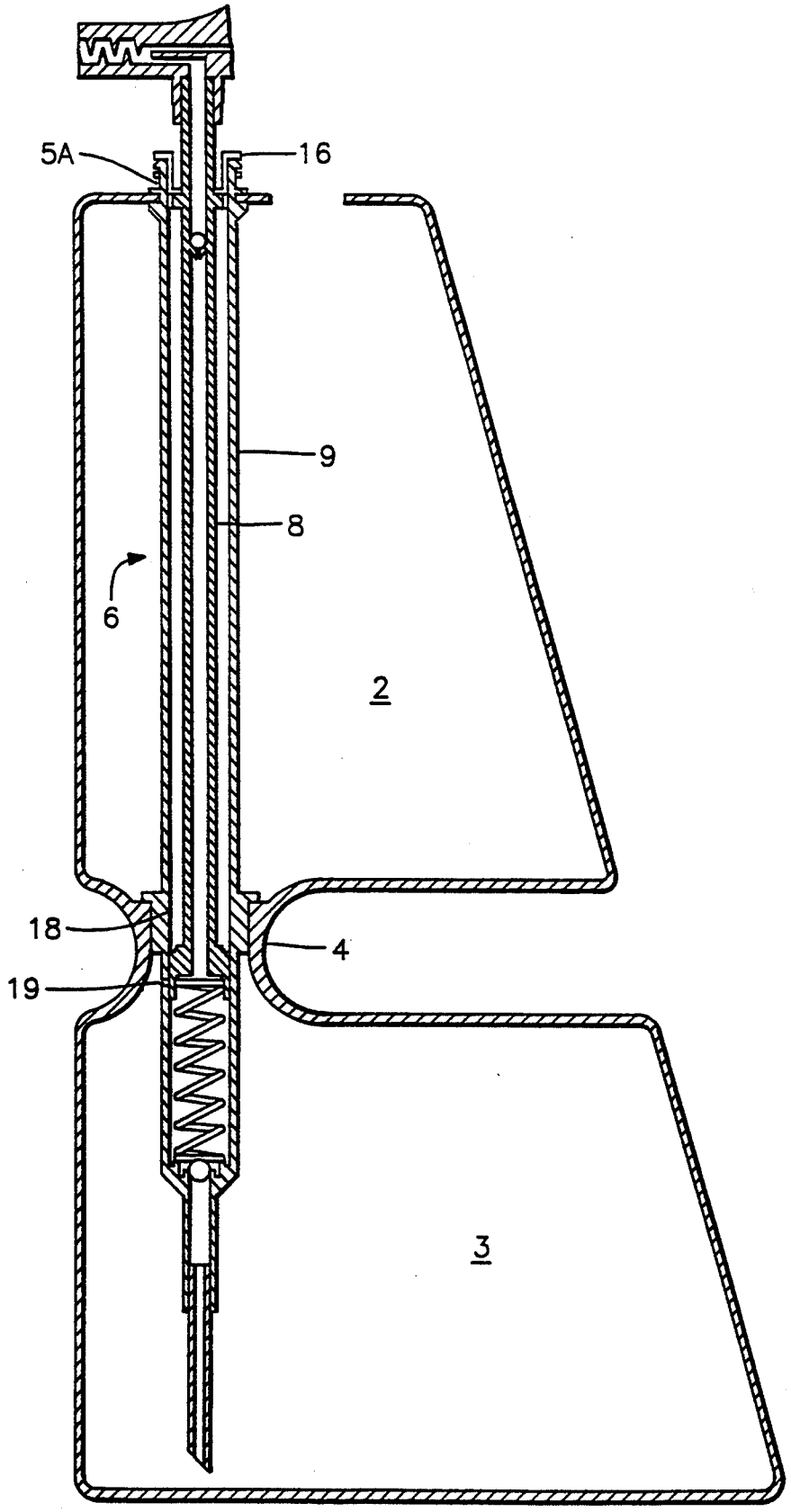
FIG. 3 illustrates the pump of FIG. 2 mounted in the container of FIG. 1.

FIG. 3 illustrates the pump depicted in FIG. 2, inserted into the container 1 through the opening 5A and through the waist 4. The stopper 18, which is integral with the casing 9, fits snugly into the waist 4, effectively segregating the upper chamber 2 from the lower chamber 3. The piston rod 8 is tapered inwardly towards its top to form a tight fit with the seal plug 16 in the non-depressed position while allowing for a small gap between the hollow piston rod 8 and the seal plug 16 when the hollow piston rod 8 is in the depressed position. When the hollow piston rod 8 is depressed, air enters the lower chamber 3 by passing through the gap between the hollow piston rod 8 and the seal plug 16 and into the lower chamber 3 through the air inlet 19 formed in a side wall of the casing 9. This prevents a vacuum from forming in the lower chamber 3 as liquid is evacuated therefrom. When the hollow piston rod 8 is in the non-depressed position, the tight fit between the hollow piston rod 8 and the seal plug 16 in conjunction with the sealing of the air inlet 19 by the piston 10 prevents any backflow of liquid from the lower chamber 3 into the casing 9 and out the container 1.

Figure 4A:
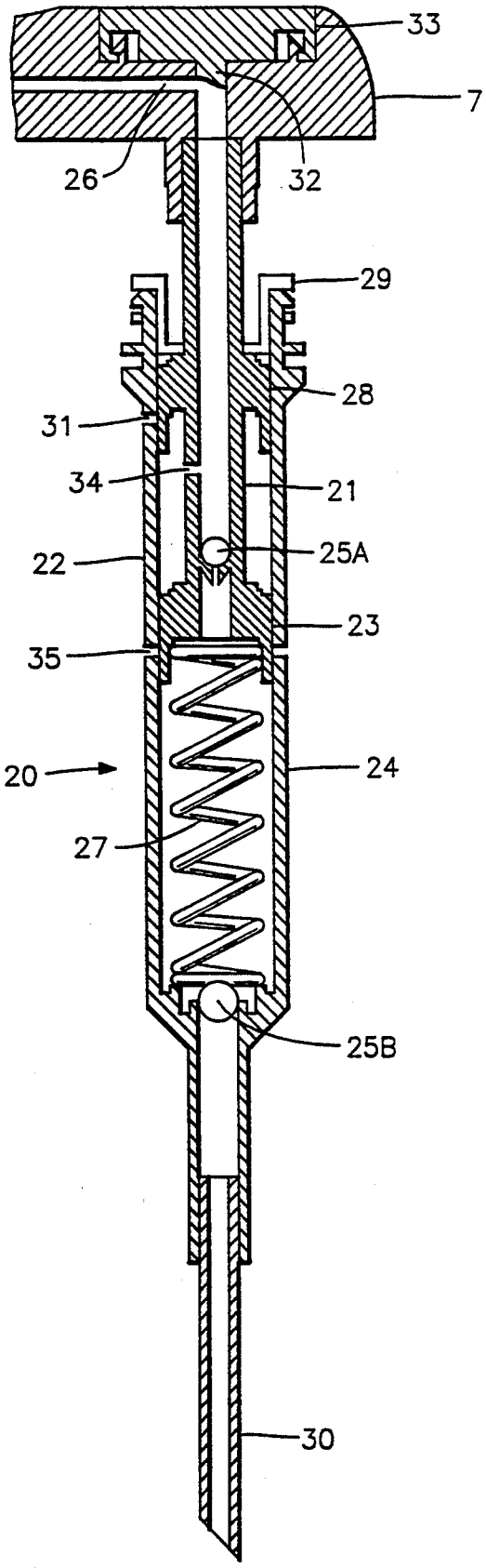
FIGS. 4A through 4C illustrate sectional views of different pump embodiments for the upper chamber of the container.
Figure 4B:
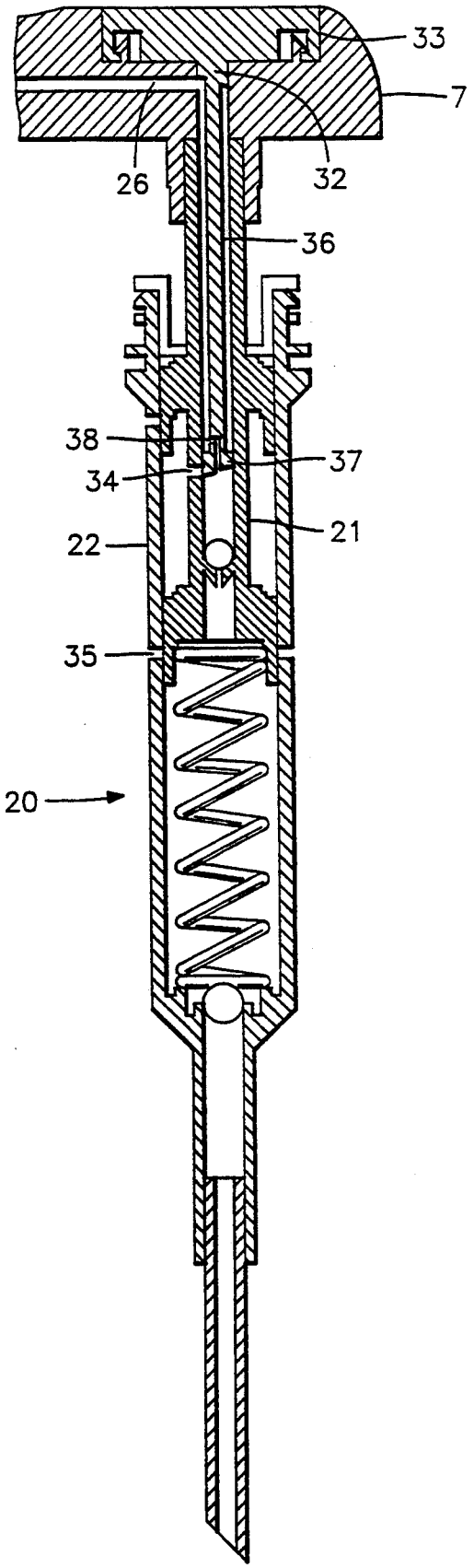
Figure 4C:
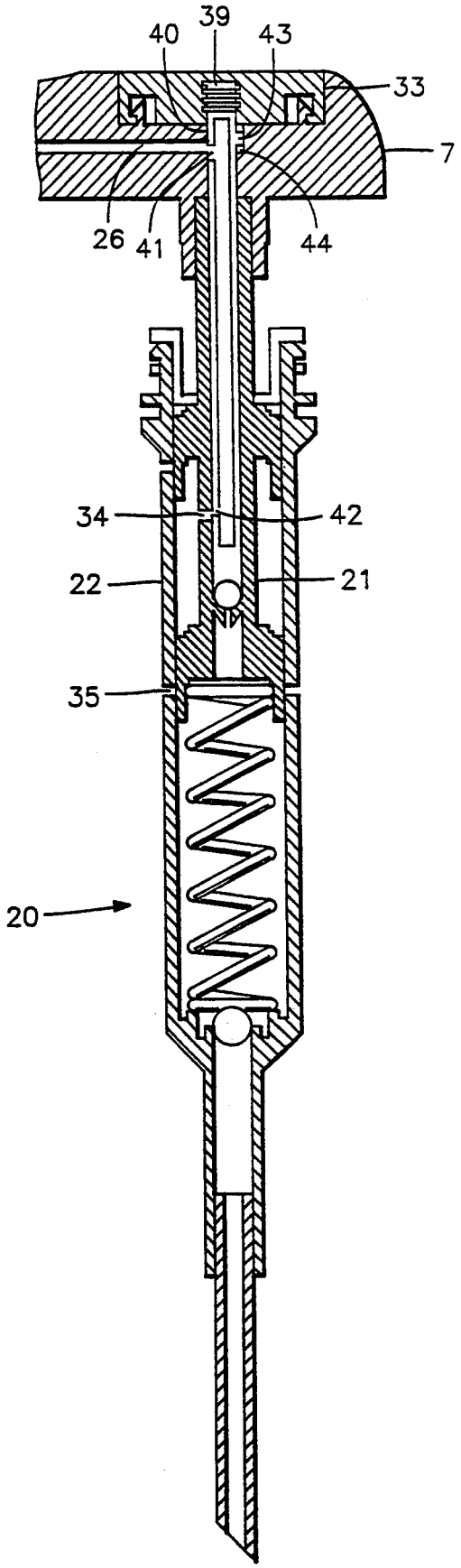

FIGS. 4A–4C illustrate different embodiments of the pump 20 servicing the upper chamber 2. In most respects, the pump 20 depicted in each of these figures works in a manner similar to the pump 6 depicted in FIGS. 2 and 3. The pump head 7, which is the same pump head as used with pump 6, is depressed to move the hollow piston rod 21 and its piston 23 downward within casing 22 through the lowermost cylindrical portion 24 of the casing 22. This movement causes all liquid in the cylindrical portion 24 to be displaced upward into the hollow piston rod 21. The two one-way valves 25A and 25B permit liquid to flow only in an upward vertical direction. The spring 27 forces the piston 23 back from its depressed position until contact of the modified stop 28, which is integral with the hollow piston rod 21 and fits snugly within the casing 22, with the seal plug 29 prevents further movement. The withdrawal of the piston 23 from the cylindrical portion 24 creates a vacuum in the cylindrical portion 24 and liquid is drawn upwardly into the cylindrical portion 24 from the upper chamber 2 through the dip tube 30. Repeated reciprocation of the pump head 7 therefore forces liquid up through the hollow piston rod 21 and out of the container 1 through the channel 26 which is formed in the pump head 7 and is in communication with hollow piston rod 21.

The modified stop 28 is integral with hollow piston rod 21 and is located below the seal plug 29. Seal plug 29 extends from the uppermost edge of casing 22 and depends downwardly therefrom, into the casing 22 and surrounding hollow piston rod 21.

The hollow piston rod 21 is tapered inwardly toward its top to form a tight fit with the seal plug 29 in the non-depressed position while allowing for a small gap between the hollow piston rod 21 and seal plug 29 when the hollow piston rod 21 is in the depressed position. When the hollow piston rod 21 is depressed, air enters the upper chamber 2 by passing through the gap between the hollow piston rod 21 and the seal plug 29 and into the upper chamber 2 through the air inlet 31 formed in the side wall of the casing 22. This prevents a vacuum from forming in the upper chamber 2 as liquid is evacuated therefrom. When the hollow piston rod 21 is in the non-depressed position, the tight fit between the hollow piston rod 21 and the seal plug 29 in conjunction with the sealing off of the air inlet 31 by the piston 23 prevents any backflow of liquid from the upper chamber 2 into the casing 22 and out the container 1.

The most significant difference between the pump 6 servicing the lower chamber 3 and the pump 20 servicing the upper chamber 2 is that the pump 20 allows the user to adjust the quantity of liquid dispensed whereas the pump 6 does not. As illustrated in FIG. 4A, the channel 26 in the pump head 7 can be closed off partially or completely by tapered portion 32 of the adjustment dial 33 by rotating the adjustment dial 33 within pump head 7. As the channel 26 is closed off by the tapered portion 32 of the adjustment dial 33, liquid is forced out the internal liquid outlet 34 formed in the side wall of the hollow piston rod 21 during depression of the pump head 7 due to constricted passage of liquid from the hollow piston rod 21 into the channel 26 and recirculated back into the upper chamber 2 through the external liquid outlets 35 formed in the side wall of the casing 22, once the piston 23 has passed external liquid outlets 35.

FIG. 4B and FIG. 4C illustrate other possible adjustment mechanisms for return of liquid removed from upper chamber 2. In the embodiment illustrated in FIG. 4B, a projection 36, which is integral with and extends from the tapered portion 32 of adjustment dial 33 down through the hollow piston rod 21, permits the partial or complete opening of the internal liquid outlet 34 by tapered terminal portion 37 of the projection 36 as a result of the rotation of adjustment dial 33. Conversely, the channel 26 is closed partially or completely by tapered portion 32 of adjustment dial 33 by the rotation of adjustment dial 33. Therefore, during depression of the pump head 7, liquid will flow in an upward vertical direction through the passage 38 formed in the tapered terminal portion 37 of the projection 36 to the channel 26 which may be fully open or partially or fully closed. Simultaneously, liquid will flow through the internal fluid outlet 34 which will be fully or partially closed or fully open to the external fluid outlets 35 and recirculated back into upper chamber 2.

In the embodiment illustrated in FIG. 4C, the adjustment dial 33 has a threaded cavity 39 into which is screwed a threaded tube 40. The threaded tube 40 fits snugly and extends down within the hollow piston rod 21 and has an upper opening 41 which aligns partially with the channel 26 and a lower opening 42 which aligns partially with the internal liquid outlet 34. The threaded tube 40 has a key 43 which locks into a keyway 44 of the pump head 7. The key 43 prevents the threaded tube 40 from turning as the adjustment dial 33 is rotated.

By rotating the adjustment dial 33, the threaded tube 40 is raised or lowered within the hollow piston rod 21 moving the upper opening 41 in the threaded tube 40 into or out of alignment with the channel 26 while the lower opening 42 conversely moves out of or into alignment with internal liquid outlet 34 thus permitting either the liquid to flow out through the channel 26, or to be recirculated back into the upper chamber 2 through internal fluid outlet 34 and external fluid outlets 35, or both. Significantly, each of the pump mechanisms illustrated in FIGS. 4A–4C utilize a piston stroke of fixed length and equal to the piston stroke of the pump 6 servicing the lower chamber 3. In addition, each of the pump mechanisms illustrated in FIGS. 4A–4C deliver liquid from the upper chamber 2 at a constant rate throughout a pump stroke of constant velocity.

Figure 5:
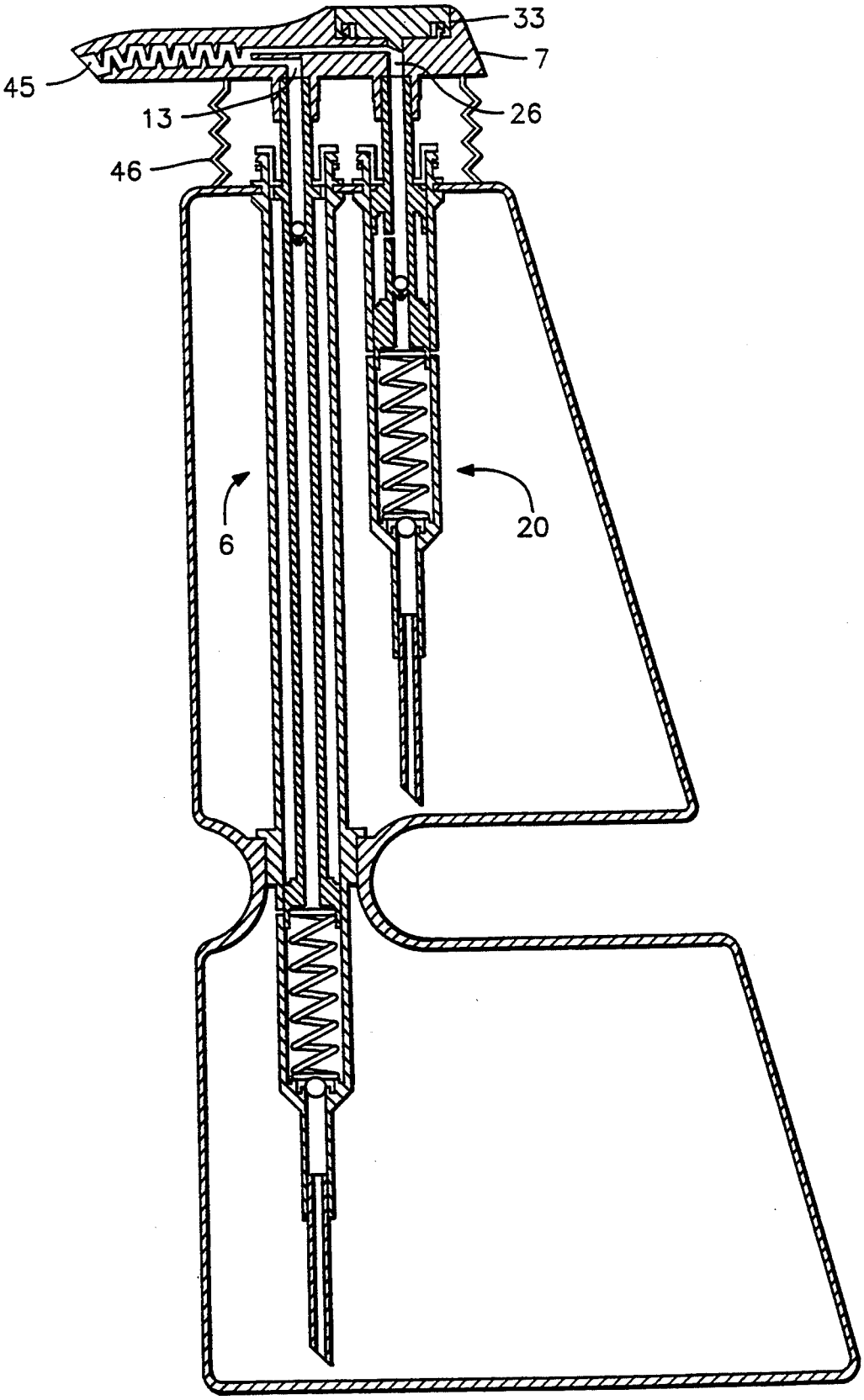
FIG. 5 is a sectional view of an assembled mechanism having two pumps, with one pump mounted in each chamber in the container of FIG. 1.

FIG. 5 illustrates the assembled dispenser mechanism. The pump described in FIGS. 4A–4C is inserted into the container 1 through the opening 5B. Channel 13 and channel 26 merge in a common channel 45 which is formed in the pump head 7. The common channel 45 is baffled and thoroughly mixes the constituent liquid from the upper chamber 2 with the constituent liquid from the lower chamber 3. A compressible collar 46 hides the tops of both pumps 6 and 20 and adds a more aesthetic appearance to the mechanism.

Because the quantity of the constituent liquid dispensed from the lower chamber 3 is constant while the quantity of the constituent liquid dispensed from the upper chamber 2 is adjustable by means of adjustment dial 33, the user can control the relative concentration of the combined liquid dispensed. The container 1 can be manufactured out of a transparent material or windows can be inserted into an opaque surface to allow the user to monitor the quantity of each constituent liquid remaining in the container.

In an alternative embodiment, the container 1 might be divided into separate chambers 2 and 3 along its vertical as opposed to horizontal axis and the pump 6 illustrated in FIG. 2 might be configured in a "traditional" manner as opposed to the elongated design with stop 15 as depicted. In addition, it is possible for both pumps to be adjustable as opposed to just one. Further, if both pumps are adjustable, the adjustment of one pump could be either dependent on or independent of the adjustment of the other. Finally, the pump head 7 may be replaced with a spray nozzle or, alternatively, the assembly could be configured for use with a trigger sprayer.

Having described the invention, many modifications thereto will become apparent to those skilled in the art to which it pertains without deviation from the spirit of the invention as defined by the scope of the appended claims.

I claim:

1. A dispenser apparatus comprising:

at least two container chambers, each of said at least two container chambers including a reservoir of fluid, at least two pumps for removing fluid from said at least two container chambers and mixing fluid together from said at least two container chambers prior to dispensing the mixed fluid, and one of said at least two pumps being mounted in one of said at least two container chambers and another of said at least two pumps being mounted in another of said at least two container chambers, said one pump including a casing having an inlet for removing fluid from the reservoir and moving the fluid removed from the reservoir up into the casing, said casing including an external fluid outlet for return to the reservoir of a controllable amount of fluid removed from the reservoir through said inlet, a piston slidably mounted in said casing, a piston rod, said piston being mounted at one end of said piston rod, said piston rod including an internal fluid outlet for passage of fluid in said piston rod to said external fluid outlet, adjustment means associated with said piston rod for varying a proportion of fluid between fluid entering said inlet and passing through said piston rod to outside of the container to fluid entering said inlet and passing through said internal fluid outlet and said external fluid outlet, back to the reservoir, said adjustment means being operable independently of a length of a stroke of the piston within the casing and effective immediately at any point of adjustment to vary the proportion of fluid between fluid passing outside the container to fluid passing back to the reservoir regardless of the position of the piston in the length of the stroke of the piston.

2. A dispenser apparatus according to claim 1, wherein said adjustment means is mounted for rotation within said piston rod to control blockage of said internal fluid outlet of said piston rod.

3. A dispenser apparatus according to claim 1, wherein said adjustment means moves axially within said piston rod to control blockage of said internal fluid outlet of said piston rod.

4. A dispenser apparatus according to claim 1, wherein said adjustment means is mounted for rotation in a pump head to control blockage of said internal fluid outlet of said piston rod.

5. A dispenser apparatus according to claim 1, wherein said adjustment means is mounted for rotation in a pump head to control blockage of a passage in said pump head.

6. A dispenser apparatus according to claim 1, wherein a pump stroke of said one pump and a pump stroke of said another pump are equal in length.

7. A dispenser apparatus according to claim 1, wherein a pump stroke of said one pump and a pump stroke of said another pump are simultaneous due to a connection to a common pump head.

8. A reciprocating pump for mounting in a reservoir of a container of fluid, said reciprocating pump comprising:

a casing, a piston slidably mounted in said casing, said piston being mounted at one end of a piston rod, and adjustment means including said piston rod and said casing for varying to any amount between 0 and 100% an amount of fluid removed from the container while simultaneously returning to the reservoir any portion of the fluid not removed from the container in an amount equaling, when added to the amount of fluid removed from the container, 100% of the fluid removed from the reservoir, in a constant proportion of fluid removed from the container to fluid returned to the reservoir during any portion of a length of a stroke of the piston within the casing, with any changes in proportion of fluid removed from the container to fluid returned to the reservoir being independent of a position of the stroke of the piston within the casing.

9. A reciprocating pump according to claim 8, wherein said adjustment means is mounted for rotation within said piston rod to control an amount of fluid removed from the container.

10. A reciprocating pump according to claim 8, wherein said adjustment means moves axially within said piston rod to control an amount of fluid removed from the container.

11. A reciprocating pump according to claim 8, wherein said adjustment means is mounted for rotation in a pump head to control fluid removed from the container.

12. A dispenser apparatus comprising:

two container chambers, each of said container chambers including a reservoir of fluid, two reciprocating pumps having a single pump head for removing fluid from said two container chambers and mixing fluid together from said two container chambers prior to dispensing the mixed fluid, one of said two pumps being mounted in one of said two container chambers and the other of said two pumps being mounted in the other of said two container chambers, said one pump including a casing having an inlet for removing fluid from the reservoir and moving the fluid removed from the reservoir up into the casing, said casing including an external fluid outlet for return to the reservoir of a controllable amount of fluid removed from the reservoir through said inlet, a piston slidably mounted in said casing, a piston rod, said piston being mounted at one end of said piston rod, said piston rod including an internal fluid outlet for passage of fluid in said piston rod to said external fluid outlet, adjustment means associated with said piston rod for varying a proportion of fluid between fluid entering said inlet and passing through said piston rod to outside of the container to fluid entering said inlet and passing through said internal fluid outlet and said external fluid outlet, back to the reservoir, said adjustment means being operable independently of a length of a stroke of the piston within the casing and effective immediately at any point of adjustment to vary the proportion of fluid between fluid passing outside the container to fluid passing back to the reservoir regardless of the position of the piston in the length of the stroke of the piston.

13. A dispenser apparatus according to claim 12, wherein said adjustment means is mounted for rotation within said piston rod to control blockage of said internal fluid outlet in said piston rod.

14. A dispenser apparatus according to claim 12, wherein said adjustment means moves axially within said rod to control blockage of said internal fluid outlet of said piston rod.

15. A dispenser apparatus according to claim 12, wherein said adjustment means is mounted for rotation in said pump head to control blockage of said internal fluid outlet of said piston rod.

16. A dispenser apparatus according to claim 12, wherein said adjustment means is mounted for rotation in said pump head to control blockage of a passage in said pump head.

17. A dispenser apparatus according to claim 12, wherein a pump stroke of said one pump and a pump stroke of said other pump are equal in length.

18. A dispenser apparatus according to claim 12, wherein a pump stroke of said one pump and a pump stroke of said other pump are simultaneous and of equal duration as controlled by said pump head.

19. A reciprocating pump for mounting in a container having a reservoir of fluid, said reciprocating pump comprising:

a casing having an inlet for removing fluid from the reservoir and moving the fluid removed from the reservoir up into the casing, said casing including an external fluid outlet for return to the reservoir of a controllable amount of fluid removed from the reservoir through said inlet, a piston slidably mounted in said casing, a piston rod, said piston being mounted at one end of said piston rod, said piston rod including an internal fluid outlet for passage of fluid in said piston rod to said external fluid outlet, adjustment means associated with said piston rod for varying a proportion of fluid between fluid entering said inlet and passing through said piston rod to outside of the container to fluid entering said inlet and passing through said internal fluid outlet and said external fluid outlet, back to the reservoir, said adjustment means being operable independently of a length of a stroke of the piston within the casing and effective immediately at any point of adjustment to vary the proportion of fluid between fluid passing outside the container to fluid passing back to the reservoir regardless of the position of the piston in the length of the stroke of the piston.

* * * * *